United States Patent [19]

Harder

[11] Patent Number: 4,655,448

[45] Date of Patent: Apr. 7, 1987

[54] EXERCISE APPARATUS

[76] Inventor: John Harder, #10 14731 - 34 St., Edmonton, Alberta, Canada

[21] Appl. No.: 740,729

[22] Filed: Jun. 3, 1985

[51] Int. Cl.[4] ..... A63B 21/00

[52] U.S. Cl. ..... 272/144; 272/120

[58] Field of Search ..... 272/144, 145, 120, 138, 272/93; 128/72–74

[56] References Cited

U.S. PATENT DOCUMENTS

| | | | |
|---|---|---|---|
| D. 258,975 | 4/1981 | Irvine | D21/191 |
| 3,219,341 | 11/1965 | Weinstein | 272/120 |
| 3,761,081 | 9/1973 | Simmons | 272/144 |
| 3,782,717 | 1/1974 | Berlin | 272/144 |
| 3,787,049 | 1/1974 | Rellinger | 272/144 |
| 3,790,164 | 2/1974 | Flanigan | 272/145 |
| 4,176,836 | 12/1979 | Coyle | 272/120 |
| 4,332,381 | 1/1982 | Lyons | 272/144 |
| 4,564,194 | 1/1986 | Dawson | 272/117 X |

FOREIGN PATENT DOCUMENTS

| | | | |
|---|---|---|---|
| 360041 | 11/1931 | United Kingdom | 272/145 |

*Primary Examiner*—Richard J. Apley
*Assistant Examiner*—S. R. Crow
*Attorney, Agent, or Firm*—George H. Dunsmuir

[57] ABSTRACT

An exercise device of the body supporting type includes a generally H-shaped frame with collapsible legs at each end thereof, so that the frame can be elevated at the foot or head end; a board or backrest pivotally connected to the head end of the frame and extending towards the foot end of the frame; handles extending outwardly from the free end of the backrest for grasping by the user when in the prone position; and footrests for anchoring the feet of a user to the foot end of the frame. By grasping the handles and pressing against the footrests, the user can rotate the backrest around the head end of the frame to an inclined position in which the user is standing on the footrests.

3 Claims, 10 Drawing Figures

EXERCISE APPARATUS

BACKGROUND OF THE INVENTION

This invention relates to an exercise device, and in particular to an exercise device of the body supporting type.

In general, exercise devices rely on springs, pulleys and cables for their operation, and consequently are somewhat complicated. The patent literature discloses exercise devices of the body supporting type which do not rely on expensive hardware. In this connection, reference is made to U.S. Pat. Nos. 3,761,081, issued to Clarence C. Simmons on Sept. 25, 1973; 3,782,717, issued to Daniel Berlin on Jan. 1, 1974; 3,787,049, issued to Oscar A. Rellinger on Jan. 22, 1974; 4,176,836, issued to Randy Coyle on Dec. 4, 1979; De. 258,975, issued to William F. Irvine on Apr. 21, 1981 and 4,332,381, issued to Sanford D. Lyons on June 1, 1982. Such patents describe structures for performing a variety of exercises. The Rellinger patent relates to a structure for performing a unique exercise of the type performed with the device of the present invention, while the Rellinger exercise structure is intended for performing the same exercise as the device of the present invention, the Rellinger structure is limited. Firstly, the feet of the user are loose, and consequently free to slip from the base of the Rellinger frame. Secondly, the Rellinger frame remains in one plane only, and consequently the structure offers no variety to the user. Finally, there are no handles on the Rellinger board for facilitating manual operation of the apparatus.

The object of the present invention is to overcome the disadvantages of the above described structures by providing an exercise device which can be used in the same manner as the Rellinger structure, and which is relatively interesting and safe to use.

BRIEF SUMMARY OF THE INVENTION

Accordingly, the present invention relates to an exercise device comprising elongated frame means; crossbar means at a foot end of said frame means for supporting the feet of a user; backrest pivotally connected to a head end of said frame means and extending towards said foot end of the frame means for rotation between a rest position on said frame means and an elevated position, the free end of said backrest means being spaced from said foot end of said frame means in the rest position; handle means extending outwardly from the free end of the backrest means for gripping by a user and extensible leg means on both ends of said frame means for changing the height of one or both ends of said frame means, whereby the frame can be inclined from said head end or from said foot end during use.

DESCRIPTION OF THE DRAWINGS

The invention will now be described in greater detail with reference to the accompanying drawings which illustrate a preferred embodiment of the invention, and wherein.

DESCRIPTION OF THE PREFERRED EMBODIMENT

Figure 1:
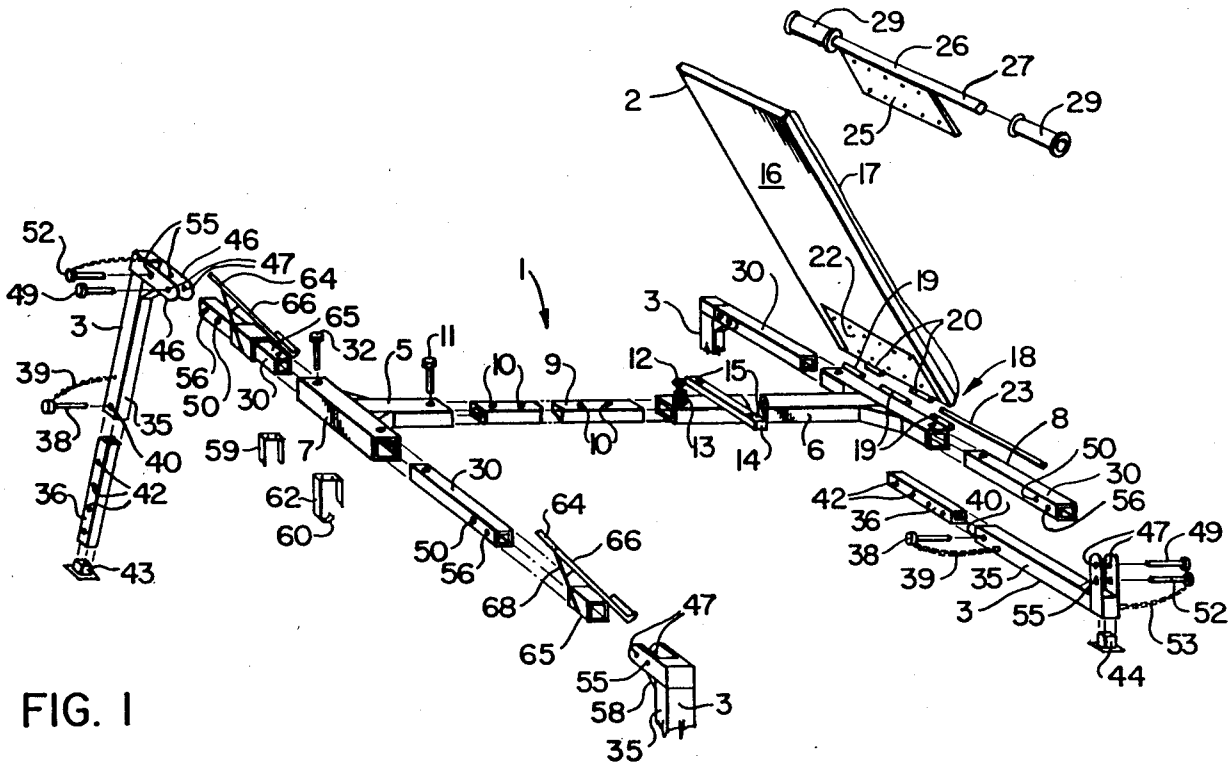
FIG. 1 is a perspective, partly exploded view of an exercise device in accordance with the present invention.
Figures 2, 3:
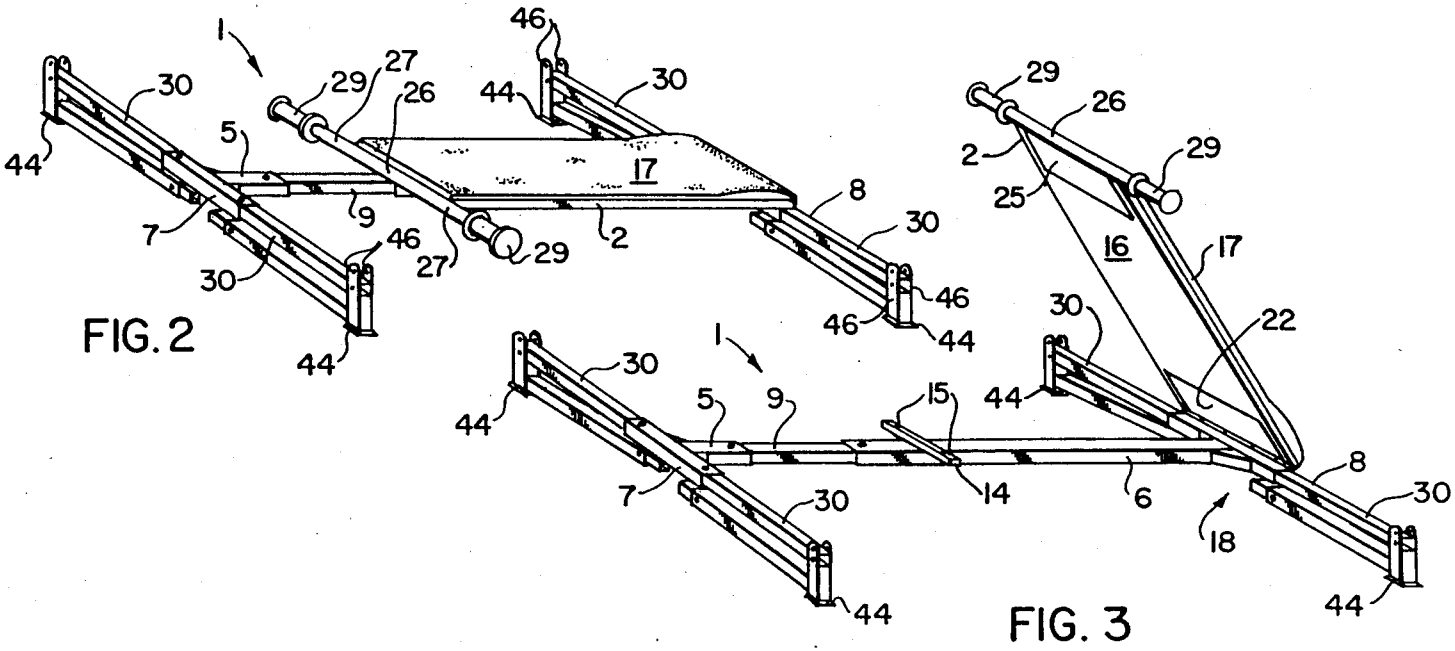
FIGS. 2 and 3 are perspective views of the device of FIG. 1 in two exercise positions.

It should be noted that in order to simplify the drawings parts have been omitted from most of the figures. A reading of the top surface of the crossbar 14. The backrest 2 includes an elongated, rectangular base plate 16, with a pad 17 on the top surface thereof. The backrest 2 is pivotally connected to the head end of the coupler 6 by a hinge generally indicated at 18 (FIGS. 1 and 3). For such purpose aligned sleeves 19 and 20 are provided on the coupler 6 and on a bottom reinforcing plate 22, respectively of the base plate 16. The plate 22 is securely mounted on the bottom of the base plate 16, so that the sleeves 20 extend outwardly therefrom. The sleeves 19 and 20 are placed in alignment, and a pin or rod 23 is slid into the sleeves to complete the hinge. A second plate 25 is connected to the bottom of the free end of the backrest 2 for supporting a pipe section 26, the outer free ends 27 of which define handles. Hand grips 29 are provided on such handles for gripping by the user.

An arm 30 extends outwardly from each side of each coupler 5 and 6, and is secured to the coupler by a bolt 32 (one shown—FIG. 1). The legs 3 are pivotally mounted on the outer free ends of the arms 30. Each leg 3 includes telescopically interconnected upper and lower, tubular sections 35 and 36, respectively which are held together by a pin 38. The pin 38 is connected to the upper section 35 by a chain 39 for insertion through a hole 40 near the bottom end of the upper leg section 35 into one of a plurality of aligned holes 42 in the lower leg section 36. Thus, the length of each leg 3 can be adjusted. A flexible foot 43 is provided on the bottom end of each leg 3. A similar foot 44 is provided on the outer top end of each leg 3.

The leg 3 is connected to the outer free end of the arm 30 by a hinge. The hinge is defined by a pair of short plates 46 connected to the top end of each leg 3. Aligned holes 47 are provided in the plate 46 for receiving a bolt 49, which extends through holes 50 in the arm 30 to pivotally connect the leg 3 to the arm 30. The leg 3 can be latched in the vertical position by a pin 52 connected to one plate 46 by a chain 53 for sliding into holes 55 and 56 (FIGS. 1 and 5) in the plate 46 and in the arm 30, respectively. When the leg 3 is in the vertical position, the holes 55 and 56 are aligned. The outer ends of the arms 30 are supported by triangular blocks 58 on the inner top ends of the legs 3.

Figure 5:
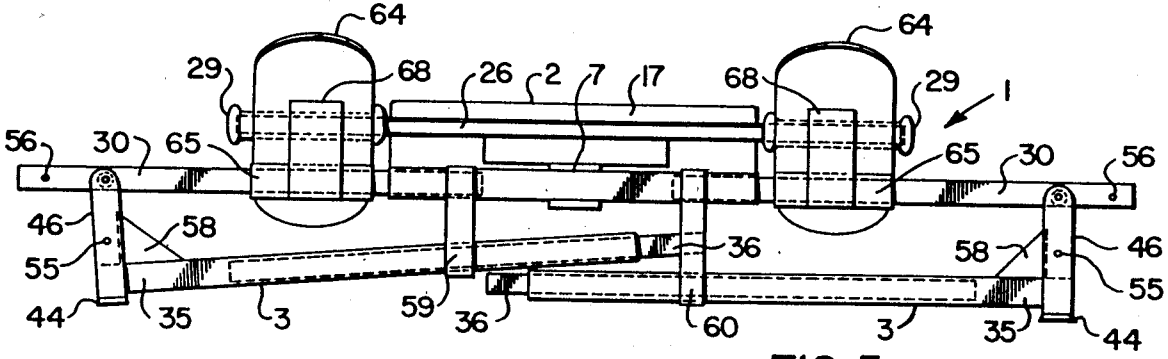
FIG. 5 is an end elevation view of the device of FIGS. 1 to 4 as viewed from the foot end thereof.
Figure 4:
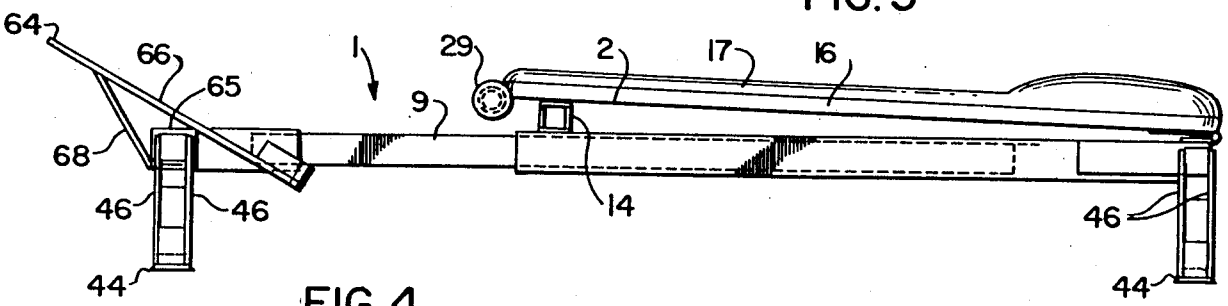
FIG. 4 is a side elevation view of the device of FIGS. 1 to 3 in the rest position.

The legs 3 can be latched in the overlapping, folded or collapsed position by means of an inverted U-shaped guide 59 and a spring bracket of clip 60 (FIGS. 1 and 5). One arm 62 of the clip 60 extends inwardly towards the other arm for engaging the lowermost leg 3 when the legs are in the folded position (FIG. 3). With the legs 3 in the folded position, the feet 44 support the frame 1 (FIGS. 2 and 3).

A pair of footrests 64 are slidably mounted on the arms 30 at the foot end of the frame 1 opposite to the backrest 2. Each footrest 64 includes a tubular base 65 (FIG. 1) for sliding on the arm 30, and an inclined foot support plate 66, a reinforcing strip 66 68 extends between the base 65 and the toe end of the footrest 64. Velcro (trademark) straps (not shown) are used to attach the feet of the user to the footrests 64. The positions of the footrests 64 can easily be adjusted to suit the user.

OPERATION

Figure 6:
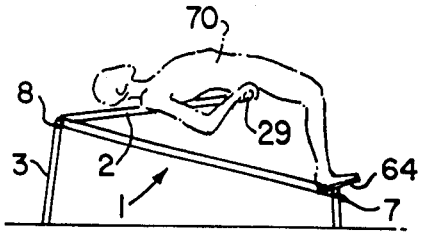
FIGS. 6 to 10 are schematic side views of the device of FIGS. 1 to 5 illustrating the use thereof.
Figure 7:
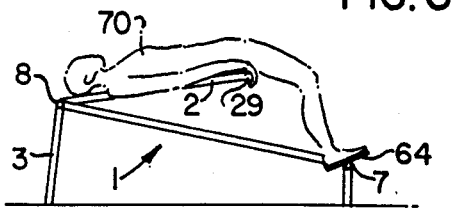
Figure 8:
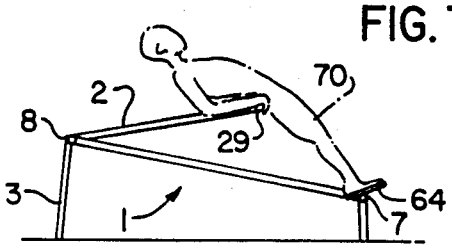

Referring to FIGS. 6 to 10, the use of the exercise device will be described. In order to use the device, the user 70 sits on the free end of the backrest 2, and places his feet on the footrests 64. The user 70 grasps the hand grips 29 and slids towards the foot end of the frame 1 until his wrists touch his upper thighs. If the feet of the user are too close together or too far apart, the footrests 64 are slid along the arms 30 to the desired positions. The user then lays full out on the backrest 2 and arches his back. The backrest 64 is pulled up against the back of the user (FIG. 6). By pushing up with the legs and feet, and then raising his head and shoulders, the backrest 64 is caused to rise, i.e. pivot around the pin 23 (FIGS. 7 and 8) until the user is standing in an inclined position on the footrests 64. The procedure is then reversed until the backrest returns to the rest position.

Figure 9:
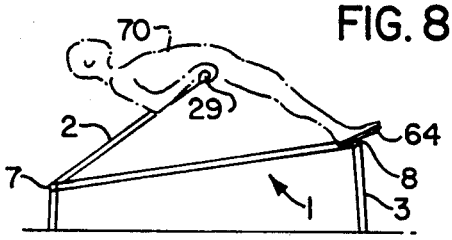
Figure 10:
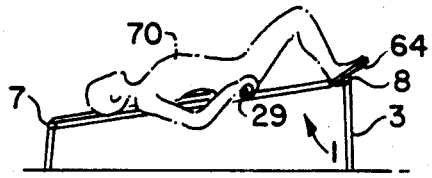

By appropriate adjustments to the legs 3, the device can be used in the horizontal position with the head and foot ends at the same height. Alternatively, the head end can be elevated (FIGS. 6 to 8) or the foot end can be elevated (FIGS. 9 and 10).

I claim:

1. An exercise device comprising a main frame and a back portion hingedly attached to said main frame at one end thereof; said main frame comprising first and second T-shaped sections; an extension bar extending between and connecting said T-shaped sections; four leg beams extending outwardly from each end of said first and second T-shaped sections in a direction generally perpendicular to said extension bar whereby two of said four leg beams are connected to said first T-shaped section and extend in opposing directions and other two of said four leg beams are connected to said second T-shaped section and extend in opposing directions; four legs, each leg pivotally attached to one of said leg beam at the end remote from the T-shaped section so that said legs may be pivoted from a closed postion in which the legs lie parallel to and adjacent the leg beams, to an open position in which the legs extend downwardly, generally perpendicular to the leg beams, whereby selectively opening and closing said legs one can vary the height of either the front or the back of the device; means on each leg for locking the legs in said open position; means on each leg beam to hold the legs in said closed position; four flexible rubber bushings positioned on the ends of said legs remote from end connected to said leg beam so that when said legs are locked in said open position, said bushings allow a flush contact with the surface upon which the device is being used; four more flexible rubber bushings positioned on the side of said legs near the end of said legs adjacent the end which is connected to said leg beams so that when said legs are in said closed position said four more bushings make a flush contact with the surface upon which the device is being used; and foot rest portions adjustably attached to said leg beams which extend from said second T-shaped section of said main frame; said back portion further comprising a rigid padded board; hinge means positioned on one end of said board for pivotally attaching said board to said first T-shaped section of said main frame; and handle means attached to other end of said board; said back rest portion extending from said first T-shaped section; whereby one positions one's self on the device by laying on one's back on said back rest portion with one's head positioned near said hinged end and one's feet engaging said foot rest portions and one then can exercise by pushing with one's feet and legs, arching one's back and neck and pulling on said handles with one's arms so that one causes the back rest portion to rise and pivot about said hinged end and thus lifting a portion of one's body.

2. The device according to claim 1, wherein said extension bar is telescopingly received in said first T-shaped section; said extension bar possesses a plurality of longitudinally spaced holes; said first T-shaped section possesses a spring loaded pin engageable with said plurality of holes in said extension bar whereby the length of the entire device may be varied by said pin selectively engaging one of said plurality of holes in said extension bar.

3. The device according to claim 1, wherein said legs further possess a leg extension bar telescopingly received in said legs; a plurality of longitudinally spaced holes located in said leg extension bars; a locking pin mechanism located on said legs for selectively engaging one of said plurality of hole in said leg extension bar to allow the height of the legs to be varied.

* * * * *